US009840821B2

(12) United States Patent
Haak et al.

(10) Patent No.: US 9,840,821 B2
(45) Date of Patent: Dec. 12, 2017

(54) GRIPPER DEVICE AND HOISTING DEVICE FOR A TRASH RAKE CLEANER, TRASH RAKE CLEANER AND METHOD THEREFOR

(71) Applicant: Cerberus Termunterzijl Beheer B.V., Termunterzijl (NL)

(72) Inventors: Robert Alexander Haak, Appingedam (NL); Harm Jan Grijpstra, Peize (NL)

(73) Assignee: Cerberus Termunterzijl Beheer B.V., Termunterzijl (NL)

( * ) Notice: Subject to any disclaimer, the term of this patent is extended or adjusted under 35 U.S.C. 154(b) by 0 days.

(21) Appl. No.: 14/906,642

(22) PCT Filed: Jul. 22, 2014

(86) PCT No.: PCT/NL2014/050499

§ 371 (c)(1),
(2) Date: Jan. 21, 2016

(87) PCT Pub. No.: WO2015/012686

PCT Pub. Date: Jan. 29, 2015

(65) Prior Publication Data

US 2016/0194845 A1 Jul. 7, 2016

(30) Foreign Application Priority Data

Jul. 22, 2013 (NL) ..... 2011205
Jul. 24, 2013 (NL) ..... 2011212

(51) Int. Cl.
*B66C 13/02* (2006.01)
*E02B 8/02* (2006.01)
(Continued)

(52) U.S. Cl.
CPC ..... *E02B 8/026* (2013.01); *B66C 1/42* (2013.01); *B66C 13/12* (2013.01); *B66C 13/38* (2013.01)

(58) Field of Classification Search
CPC ..... E02B 8/026; B66C 1/42; B66C 13/12; B66C 13/38
(Continued)

(56) References Cited

U.S. PATENT DOCUMENTS 2,904,181 A * 9/1959 Baker ..... E02B 8/026 210/159
4,950,125 A * 8/1990 Gravenhorst ..... B66C 23/64 254/379

FOREIGN PATENT DOCUMENTS

DE 1055455 4/1959
DE 2335739 3/1974
(Continued)

OTHER PUBLICATIONS

International Search Report issued in parent International Application No. PCT/NL2014/050499, dated Jan. 16, 2015, European Patent Office, 7 pages.
(Continued)

*Primary Examiner* — Patrick J Maestri
(74) *Attorney, Agent, or Firm* — McDonnell Boehnen Hulbert & Berghoff LLP

(57) ABSTRACT

A gripper device comprises a gripper with a gripper arm rotatable around a rotation axis such that the gripper is movable between an open end position and a closed end position, and a hoisting device connected to the gripper and comprising a first cable and a second cable which are each connected with their one outer end to the gripper and are each connected with their other outer end to respectively a first and second hoisting means for raising and lowering the gripper with the cables, wherein each hoisting means is, driven by a separate drive, wherein a controller transmits the same control signal to both drives for the purpose of raising or lowering the gripper, and each drive comprises a motor with internal slippage or a slippage coupling so that synchronous running of the hoisting means is automatically realized.

19 Claims, 10 Drawing Sheets

(51) Int. Cl.
*B66C 13/12* (2006.01)
*B66C 13/38* (2006.01)
*B66C 1/42* (2006.01)

(58) Field of Classification Search
USPC ..... 414/685, 711, 721–724
See application file for complete search history.

(56) References Cited

FOREIGN PATENT DOCUMENTS

| | | |
|---|---|---|
| DE | 3629145 | 3/1988 |
| GB | 432342 | 7/1935 |
| GB | 761644 | 11/1956 |
| JP | S62 59712 | 3/1987 |

OTHER PUBLICATIONS

Written Opinion issued in parent International Application No. PCT/NL2014/050499, dated Jan. 16, 2015, European Patent Office, 11 pages.

* cited by examiner

GRIPPER DEVICE AND HOISTING DEVICE FOR A TRASH RAKE CLEANER, TRASH RAKE CLEANER AND METHOD THEREFOR

This application is a National Stage Application of International Patent Application No. PCT/NL2014/050499, filed Jul. 22, 2014, which claims the benefit of, and priority to, Netherlands Patent Application No. 2011205, filed Jul. 22, 2013, and Netherlands Patent Application No. 2011212, filed Jul. 24, 2013, the contents of these applications being incorporated entirely herein by reference.

The invention relates to a gripper device for a trash rake cleaner. Trash rakes are applied at water works, for instance at water treatment plants, pumping plants, hydroelectric power plants and cooling water installations. A trash rake prevents passage of material entrained by the water. Once a great deal of entrained material has accumulated in front of the trash rake, the trash rake has to be cleaned since the throughflow of water would otherwise be blocked. A trash rake cleaner is utilized for this purpose. A trash cleaner comprises, among other parts, a gripper which can grab the accumulated material out of the water.

In conventional trash rake cleaners the gripper must be opened and closed by means of a hydraulic system. A drawback of hydraulics is that the mineral or synthetic oils used as hydraulic fluid are harmful to the environment. Using hydraulics for water supply can result in water contamination. Although hydraulic fluids on the basis of vegetable oils are meanwhile available, these have the drawback that they have to be completely replaced about every four years. This makes such hydraulic systems maintenance-intensive.

GB 761644 describes a gripper which is operated with two groups of cables. The first group of cables serves the purpose of opening and closing the gripper and the second group of cables serves for raising and lowering the gripper.

This has the drawback that a drive must be provided for both the first group of cables and the second group of cables. Particularly in the case of a gripper with a relatively great weight, multiple cables with associated drum and drive will have to be provided for the purpose of raising and lowering the gripper. In addition, a separate drum with drive must be provided for each of the cables for opening and closing the gripper.

A further drawback is that the groups have to be adapted to each other so as to prevent unintentional opening or closing of the gripper. This makes the required control complex.

An object of the invention is to obviate the above stated problems and to provide a gripper device for a trash rake cleaner which does not incorporate any hydraulics and which, even when the gripper has a relatively great weight, needs only a minimum number of drives, and the construction of which is effective and safe.

This object is achieved with the gripper device for a trash rake cleaner according to the invention, comprising:

- a gripper with a gripper arm rotatable around a rotation axis such that the gripper is movable between an open end position and a closed end position; and
- a hoisting device connected to the gripper and comprising a first cable and a second cable which are each connected with their one outer end to the gripper and are each connected with their other outer end to respectively a first and second hoisting means for raising and lowering the gripper with the cables, characterized in that the first cable is attached to the gripper arm at the position of a first point of engagement and the second cable is attached to the gripper arm at the position of a second point of engagement, wherein the points of engagement are provided on either side of the rotation axis such that upward movement of the first cable relative to the second cable carries the gripper to the open end position and upward movement (i.e. pulling or hoisting) of the second cable relative to the first cable carries the gripper to the closed end position, wherein in the open end position the moment arm of the tensioning force in the first cable relative to the rotation axis is greater than the moment arm of the tensioning force in the second cable relative to the rotation axis, and in the closed end position the moment arm of the tensioning force in the first cable relative to the rotation axis is smaller than the moment arm of the tensioning force in the second cable relative to the rotation axis.

In the gripper device according to the invention two cables serve for both raising and lowering and for opening and closing of the gripper. It is hereby possible to dispense with a separate cable or cables, or separate hydraulics, for the purpose of opening and closing the gripper.

The construction moreover guarantees that the gripper remains in the desired end position, also when the cables are not displaced wholly synchronously for raising or lowering the gripper. This is because, when the gripper is opened, the force required to rotate the gripper arm to the closed position is greater than the force required to hold the gripper in the open position. So even when the tensioning forces in the cables differ to some extent due to the non-synchronous running of the hoisting means, the gripper will remain in the open end position. A similar consideration applies to the closed end position in which the force for opening the gripper is greater than that for closing thereof.

In other words, the gripper is movable to a selected one of the open end position and the closed end position by respectively taking in and paying out the first cable relative to the second cable, while simultaneous hoisting or lowering of the cables respectively raises or lowers the gripper into the selected end position.

The moment arm of a force relative to a point of rotation is defined by the perpendicular distance of this rotation point to the line of force, i.e. the line in the direction in which the force acts, this line passing through the point of engagement of the force (line of action).

An additional advantage of the gripper device according to the invention is that operation is possible in simple manner at greater depths than with conventional gripper devices for trash rake cleaners. In conventional gripper devices the vertical distance which the gripper can cover is limited to about 15 meters, for instance because at greater distances the hydraulic lines begin to bend because they are carried along by the flow of the water, and are moreover likely to begin leaking. There are situations however in which trash rakes lie at a much deeper level, even up to 100 meters. In current practice these trash rakes are cleaned manually since conventional trash rake cleaners will not suffice for this purpose. With the invention it becomes possible to clean such deeper level trash rakes. This can be realized by applying the correct cable length. Because no hydraulics are required according to the invention, no additional (complex) provisions need be provided on the gripper or hoisting installation to make them suitable for such great vertical distances. It is also possible to dispense with long hydraulic lines for the purpose of spanning these distances.

It is noted that it is possible to provide a plurality of cables, for instance when the weight of the gripper requires this. In this case a first group and a second group of cables are provided on either side of the rotation axis. Upward movement of the first group of cables relative to the second group of cables will in that case carry the gripper to the open end position, and upward movement of the second group of cables relative to the first group of cables will carry the gripper to the closed end position. Once again a separate cable is in this case not required for the purpose of opening or closing the gripper. This makes the construction according to the invention relatively simple, wherein it can in addition be embodied with relatively few components. This also makes repair simpler.

The points of engagement are provided on either side of the rotation axis, i.e. they are provided on either side of a vertical line through the rotation axis. In other words, the rotation axis is situated on the gripper arm at a position between the points of engagement on this same gripper arm.

According to the invention the gripper device can also be utilized for applications other than a trash rake cleaner.

In a currently preferred embodiment the gripper device complies with the ATEX (ATmosphères EXplosibles) guideline wherein sparking is prevented. This is particularly relevant at water treatment plants because of methanogenesis. The gripper for instance comprises components, such as teeth, which prevents sparking. The gripper is for instance provided with a layer which prevents sparking. The gripper for instance comprises aluminium or bronze or an alloy thereof. The device for instance comprises a motor which complies with the ATEX guideline.

According to the invention each hoisting means is driven by a separate drive, wherein the gripper device further comprises a controller connected to the drives for controlling the drives by transmitting a control signal with the controller, wherein the controller has a hoisting mode in which the controller is configured to transmit the same control signal to both drives for the purpose of raising or lowering the gripper, wherein each drive comprises a slippage coupling or a motor with internal slippage such that synchronous running of the hoisting means is automatically realized in the hoisting mode.

The controller can transmit the control signal in wireless or wired manner to the drive.

The controller for instance comprises a frequency control. The controller preferably comprises only one frequency control for controlling both drives.

According to the invention it is not necessary to synchronize the driving. This is because slippage, also referred to as internal slippage, occurs in many types of motors, such as in the case of electric motors and hydraulic motors. This is also referred to as electromagnetic slippage in the case of electric motors. This slippage is the difference between the rotation frequency of the motor and the drive frequency, often expressed as a percentage of the drive frequency. The load determines the slippage of the motor. If the gripper is displaced and the motors are not synchronized, the motor with the heavier load will decelerate and the motor with the light load will accelerate. A uniform distribution of the load is hereby obtained automatically. It is hereby possible to dispense with a synchronization mechanism.

The motors preferably have substantially the same specifications. This limits the complexity. A balanced construction is moreover hereby obtained. The drives are not coupled and function independently. As a result of the slippage the path covered by the respective cable in the case of an increasing load will be shorter, while the path covered in the case of a decreasing load will be longer. The power supplied by the drives hereby remains substantially constant. If motors of about the same power are applied, this will result in a uniform distribution of the load.

It is noted that conventional gripper devices comprise encoders which measure the rotation and/or rotation speed of the drives, wherein the output of the encoders is used as feedback in the control of the drives. Since synchronization is not necessary according to the invention, it is possible to dispense with encoders or similar sensors, and likewise with a control with feedback.

In a preferred embodiment the controller comprises a switch for switching between the hoisting mode and a gripper mode, in which gripper mode the controller is configured to transmit to at least one of the drives a control signal for the purpose of opening or closing the gripper which is not transmitted to the other drive.

Depending on the desired action, the controller, for instance a frequency control, will control both drives simultaneously (raising and lowering) or one of the drives (opening and closing). The drives preferably have the same orientation so that for raising and lowering purposes both drives produce a rotation in the same rotation direction.

The controller preferably transmits a control signal to only one of the drives in the gripper mode.

Each drive preferably comprises an electric motor, such as an asynchronous electric motor.

In a further preferred embodiment each drive is suitable to bear in any case 50% of the combined load, preferably in any case 75% and more preferably in any case 100%.

The drives are preferably suitable, in the case that one drive fails, to still be able to raise the gripper. The drives preferably have in any case sufficient power to raise the gripper in an empty state, i.e. without scooped-up material. That is, the minimum combined load that each drive can bear is at least equal to the weight of the gripper.

A typical gripper weight is 300-1500 kg. In addition, it is also possible to allow for the additional weight of the material for hoisting. Typical gripper devices are configured to carry 0.8-2.5 times the weight of the gripper in scooped-up material.

In the case of two cables with two drives, each drive is suitable to bear in any case 50% of the weight of the gripper, for instance 60%. In the case of four cables, two on each side of the rotation axis, and four drives, the drives are each suitable to bear in any case 25% of the weight of the gripper, preferably at least 33%. Two drives alternatively each carry two cables, wherein each drive is suitable to bear in any case 50% of the weight of the gripper, preferably at least 100%.

In an alternative embodiment the hoisting device further comprises a slippage coupling. This slippage coupling is configured to generate slippage when the drive used does not itself generate any slippage. The slippage coupling can also be used to enhance the above described effect.

In a preferred embodiment the gripper is mounted on a frame which is also provided with one or more redirecting means for redirecting the cables, wherein each cable is guided from the respective hoisting means along the one or more redirecting means to the gripper arm.

The redirecting means for instance comprises pulleys, sheaves or redirecting rollers.

As a result of the redirecting means the line of action of the force always remains the same even if the centre of gravity of the gripper changes due to opening or closing of the gripper. The line of action of the force is hereby well defined and proper operation of the machine is guaranteed. In addition, the cables are prevented from becoming entangled.

A further effect of the redirecting means is that the difference in moment arm of the moments of force around the rotation axis is increased. The cables run at an angle from the redirecting means to the points of engagement. This angle is greater than the angle which the cables would make without the redirecting means, since the distance between redirecting means and the gripper arm is shorter than the distance between the hoisting means and the gripper arm. This enhances the above described effect of holding the gripper in the selected end position.

The redirecting means are preferably provided relative to the hoisting means such that each cable runs substantially vertically in the area from the respective hoisting means to the redirecting means. The load of the gripper with frame is hereby distributed over the first and second hoisting means, i.e. over the drive thereof.

In a preferred embodiment the gripper comprises at least one stop for bounding the movement of the gripper arm.

The gripper for instance comprises two stops which form a bounding of the movement of the gripper arm in two rotation directions. The closed end position and the open end position are hereby defined.

In a preferred embodiment the rotation axis is provided outside the vertical plane midway between the cables.

Placing the rotation axis out of centre influences the angle which the cables make with the vertical plane. The moment arm of the moments of force are hereby also influenced relative to the rotation axis: the arm on the one side of the rotation point is increased, while the arm on the other side is reduced. A greater force is hereby exerted for the purpose of holding the gripper in the open or closed end position.

In the case the first cable is guided along a first redirecting means and the second cable along a second redirecting means, the rotation axis is not therefore located on the perpendicular bisector between the point at which the first cable is redirected by the first redirecting means and the point at which the second cable is redirected by the second redirecting means.

The rotation axis is preferably situated on the side of the first cable relative to the centre so that the moment arm for holding the gripper arm in the opened position is increased. Although the moment arm for holding the gripper arm in the closed position is hereby reduced, it is noted that in the closed position the gripper arm benefits from the weight of the load for the purpose of keeping the gripper arm closed.

For the same purpose the distance from the rotation axis to the first point of engagement differs in a further preferred embodiment from the distance from the rotation axis to the second point of engagement. Alternatively or additionally, an additional weight is provided for this purpose on the gripper.

In a preferred embodiment the rotation axis is arranged above a line connecting the first point of engagement to the second point of engagement. In other words, when an imaginary line is drawn from the first point of engagement to the second point of engagement, the rotation axis is then located above this line.

In a preferred embodiment each hoisting means comprises a drum, and the drums are arranged above one another. This makes the device according to the invention compact. The drums can moreover have the same rotation direction. Each hoisting means preferably comprises a drum of the same diameter. In another embodiment the drums are arranged adjacency of each other.

The invention can be applied with different cable lengths, for instance between 1 meter and 15 meters. In a preferred embodiment the cables have a length of at least 20 meters, more preferably at least 40 meters, more preferably at least 60 meters, still more preferably at least 80 meters and most preferably at least 100 meters.

The gripper device optionally comprises a detection system for detection of a slack cable. Slack can occur in a cable for instance if the gripper becomes jammed or if one of the cables snaps. If a cable is slack the tension in the other cables can become too great, which results in a hazardous situation. The detection system is preferably coupled to the controller so that this latter can stop movement of the gripper on the basis of detection of a slack cable. The controller is for instance adjusted, when a slack cable is detected, to switch off the drives, to switch on an emergency system, to generate an alarm and/or to move the gripper downward so that it can rest on a ground surface. The detection system for instance comprises redirecting rollers along which the cables of the device are guided and a sensor which is coupled to at least one of the redirecting rollers and which is configured to measure the force which the cables exert on the redirecting rollers and/or changes in this force.

The invention further relates to a gripper device for a trash rake cleaner, comprising

- a gripper with a gripper arm which is rotatable around a rotation axis such that the gripper is movable between an open end position and a closed end position;
- a hoisting device connected to the gripper and comprising a first hoisting means, a second hoisting means and a cable, the cable comprising a first cable part which comprises the one outer end of the cable and a second cable part which comprises the other outer end of the cable, wherein the one outer end is connected to the first hoisting means and the second outer end is connected to the second hoisting means; and
- a redirecting means which is connected fixedly to the rotation axis and around which the cable extends for the purpose of raising and lowering the gripper arm by simultaneously respectively hoisting and lowering the first cable part and the second cable part, carrying the gripper arm to the open end position by hoisting the first cable part relative to the second cable part and carrying the gripper arm to the closed end position by hoisting the second cable part relative to the first cable part, wherein in the open end position the moment arm of the tensioning force in the first cable part relative to the rotation axis is greater than the moment arm of the tensioning force in the second cable part relative to the rotation axis, and in the closed end position the moment arm of the tensioning force in the first cable part relative to the rotation axis is smaller than the moment arm of the tensioning force in the second cable part relative to the rotation axis.

In other words, the cable forms a loop in which the redirecting means, and thereby the gripper, is suspended.

This gripper device can be combined as desired with the features of the above described embodiments. Each hoisting means is for instance driven by a separate drive, wherein a controller is configured to send both drives the same control signal for the purpose of raising or lowering the gripper, each drive comprising a motor with internal slippage or a slippage coupling such that in the hoisting mode a synchronous running of the hoisting means is automatically realized.

The length of the described moment arms are preferably determined by the redirecting means. This length is for instance determined by the form of the redirecting means and/or the position at which the redirecting means is connected to the rotation axis.

The gripper arm in the open end position is preferably rotated through more than 90 degrees relative to the closed end position, preferably more than 120 degrees, more preferably more than 150 degrees and most preferably about 180 degrees.

In a further preferred embodiment the redirecting means has a plurality of substantially straight sides, wherein in any case two sides have an unequal length. Because of the rotation of the redirecting means with the rotation axis of the gripper the path of the cable along the redirecting means changes, whereby the length of the moment arm changes.

The redirecting means has for instance substantially the form of a polygon, such as a triangle. The corners of the polygon are for instance rounded to some extent in order to prevent the redirecting means cutting into the cable.

The invention further relates to a hoisting device for a trash rake cleaner, comprising a first cable and a second cable which are each connected with their one outer end to a load carrier, such as a gripper, and which are each connected with their other outer end to respectively a first and second hoisting means for the purpose of raising and lowering the load carrier with the cables, characterized in that each hoisting means is driven by a separate drive, the hoisting device further comprising a controller connected to the drives for controlling the drives by transmitting a control signal with the controller, wherein the controller has a hoisting mode in which the controller is configured to send the same control signal to both drives for the purpose of raising or lowering the gripper, each drive comprising a motor with internal slippage or a slippage coupling such that in the hoisting mode a synchronous running of the hoisting means is automatically realized.

The same advantages and effects apply for this hoisting device as described above for the gripper device. Features of the above-mentioned gripper device can in particular be selectively combined with the hoisting device according to the invention. In such a combination another load carrier can also be applied instead of a gripper.

The invention also relates to a trash rake cleaner comprising the above described gripper device or hoisting device.

In addition, the invention relates to a method for raising, lowering, opening and closing a gripper for a trash rake cleaner as described above, the method comprising the steps of:

- rotating the gripper arm around the rotation axis for the purpose of opening the gripper by moving the first cable upward relative to the second cable;
- rotating the gripper arm around the rotation axis for the purpose of closing the gripper by moving the first cable downward relative to the second cable;
- raising the gripper by moving both cables upward; and
- lowering the gripper by moving both cables downward.

The same advantages and effects apply for the trash rake cleaner and the method according to the invention as described above for the gripper device and the hoisting device.

Further advantages, features and details of the invention are elucidated on the basis of preferred embodiments thereof, wherein reference is made to the accompanying figures.

Figure 1:
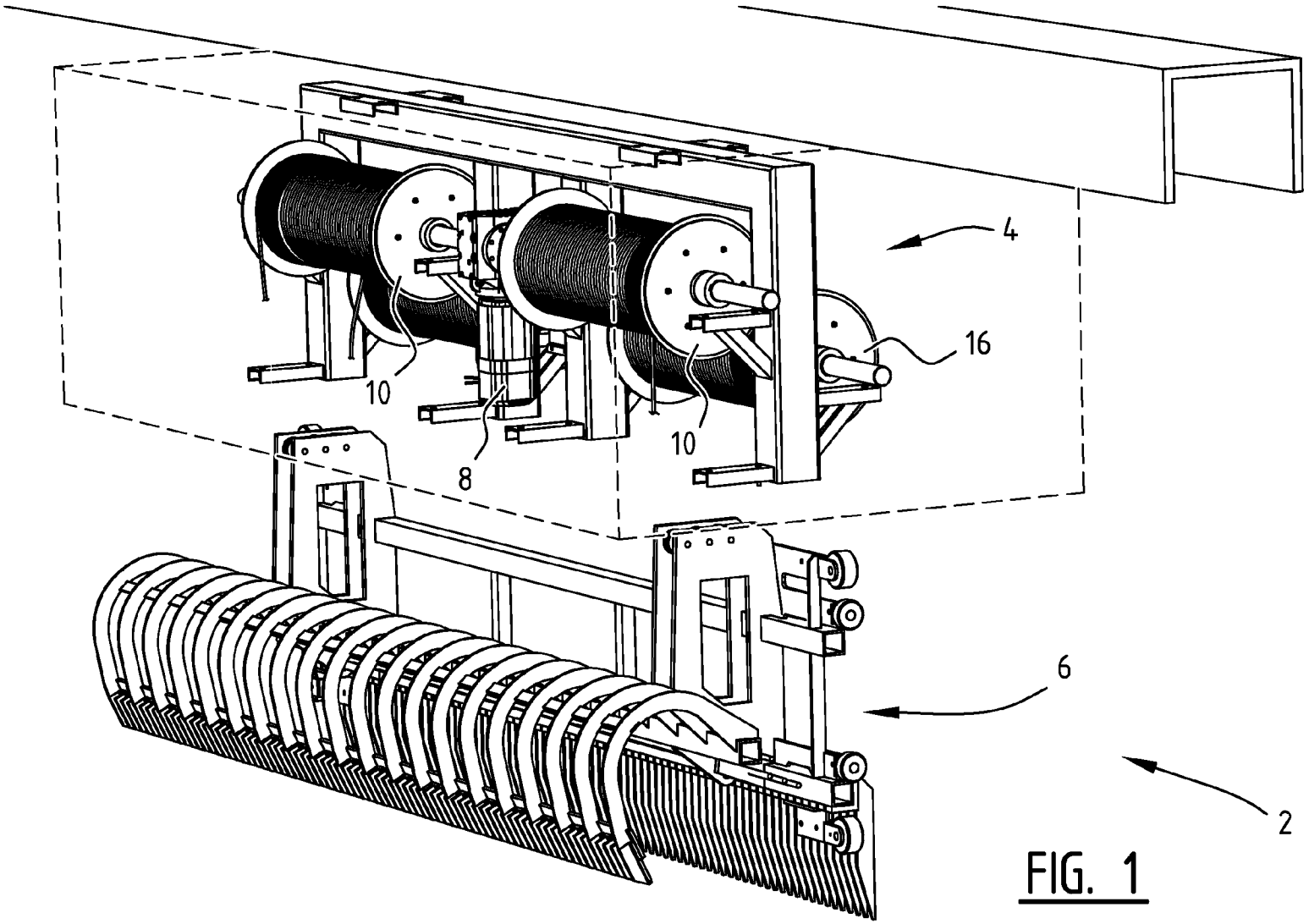
FIG. 1 is a perspective view of the gripper device according to the invention.
Figure 2:
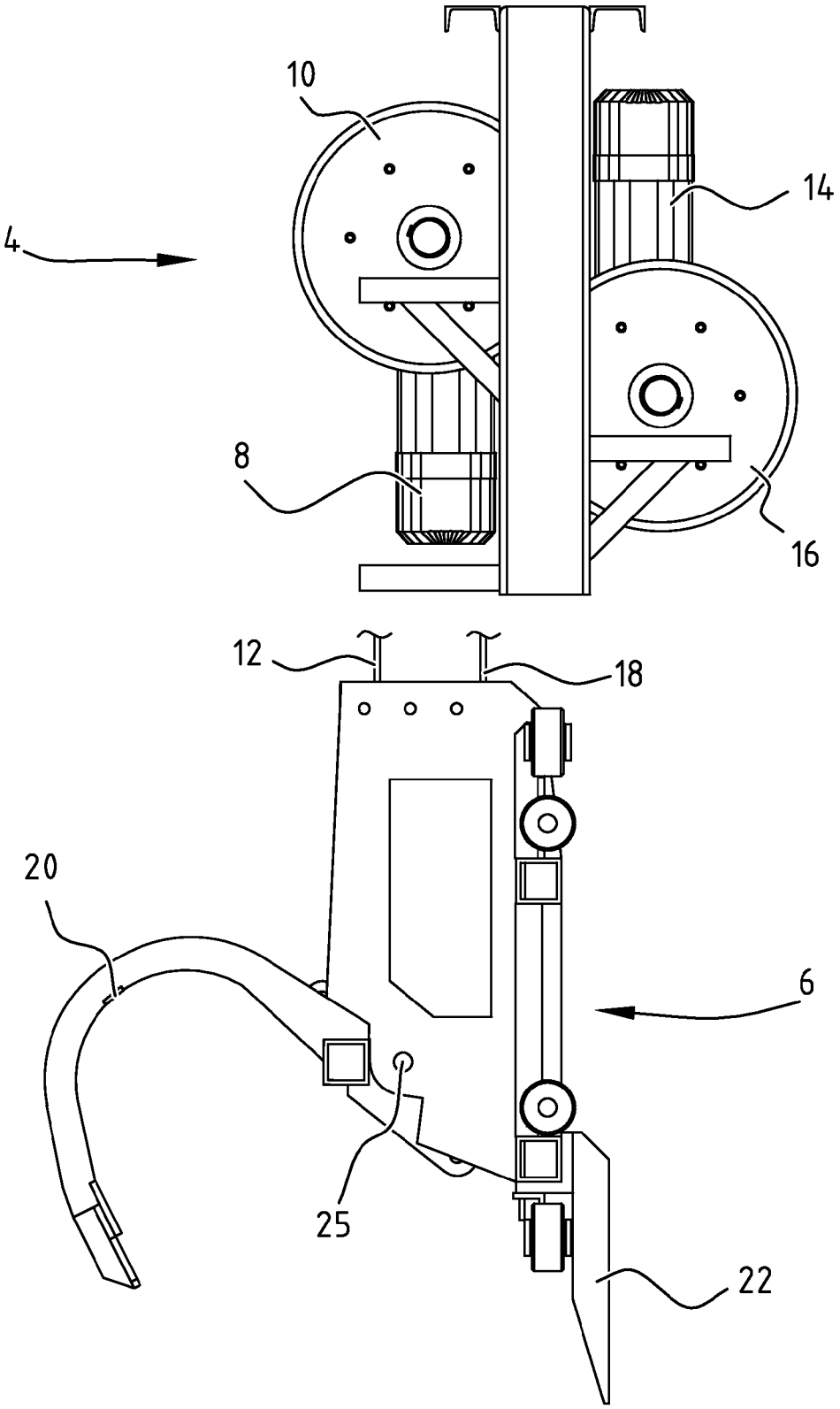
FIG. 2 is a side view of the device of FIG. 1.

Gripper device 2 (FIG. 1) comprises hoisting device 4 and gripper 6. Hoisting device 4 comprises asynchronous electric motors 8 (FIGS. 1 and 2) which drive drums 10 in rotation. First cables 12 run over drums 10. Hoisting device 4 further comprises two electric motors 14 of the same type as motors 8. Motors 14 drive drums 16 for the purpose of hoisting or lowering cables 18.

Figure 3:
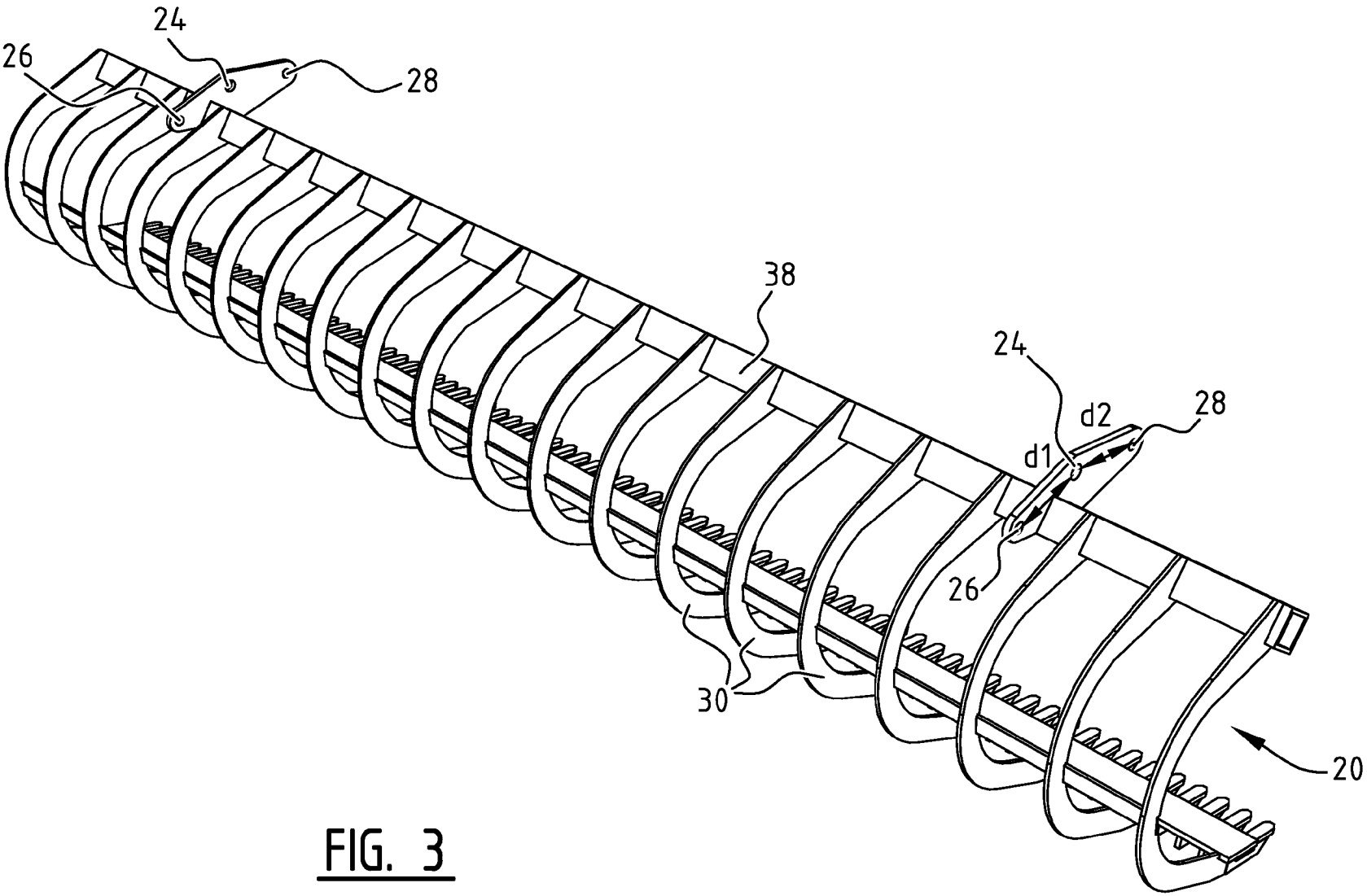
FIG. 3 is a perspective view of the gripper arm of the device.

Gripper 6 comprises a movable gripper arm 20 and a fixed gripper arm 22. Movable gripper arm 20 comprises a tilting arm 29 with an opening 24 (FIG. 3) for receiving shaft 25 so that gripper arm 20 can rotate around this shaft. Also provided in tilting arm 29 are openings 26 and 28 to which respective cables 12 and 18 are attached. The distance from opening 26 to opening 24 for the rotation axis is d1, the distance from opening 28 to opening 24 is d2. Gripper arm 20 is provided with teeth 30 at a mutual distance such that they fit between the bars of a trash rake for cleaning.

Figure 4B:
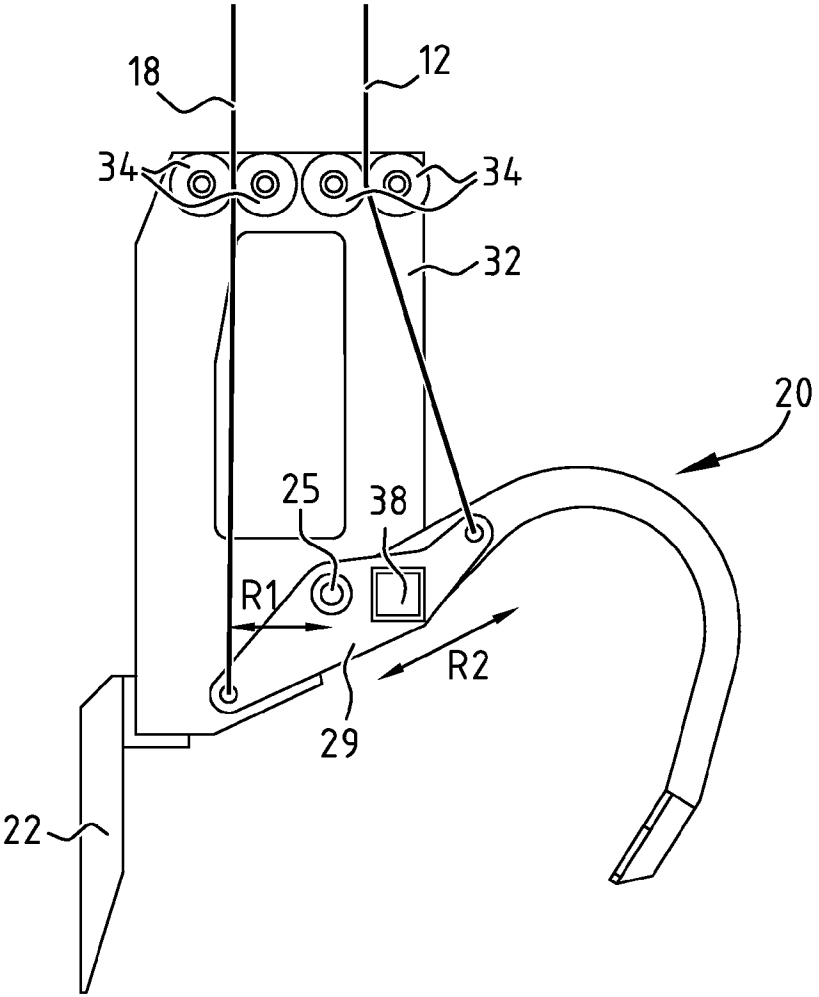
FIG. 4B is a side view of the gripper device in the opened end position.
Figure 4A:
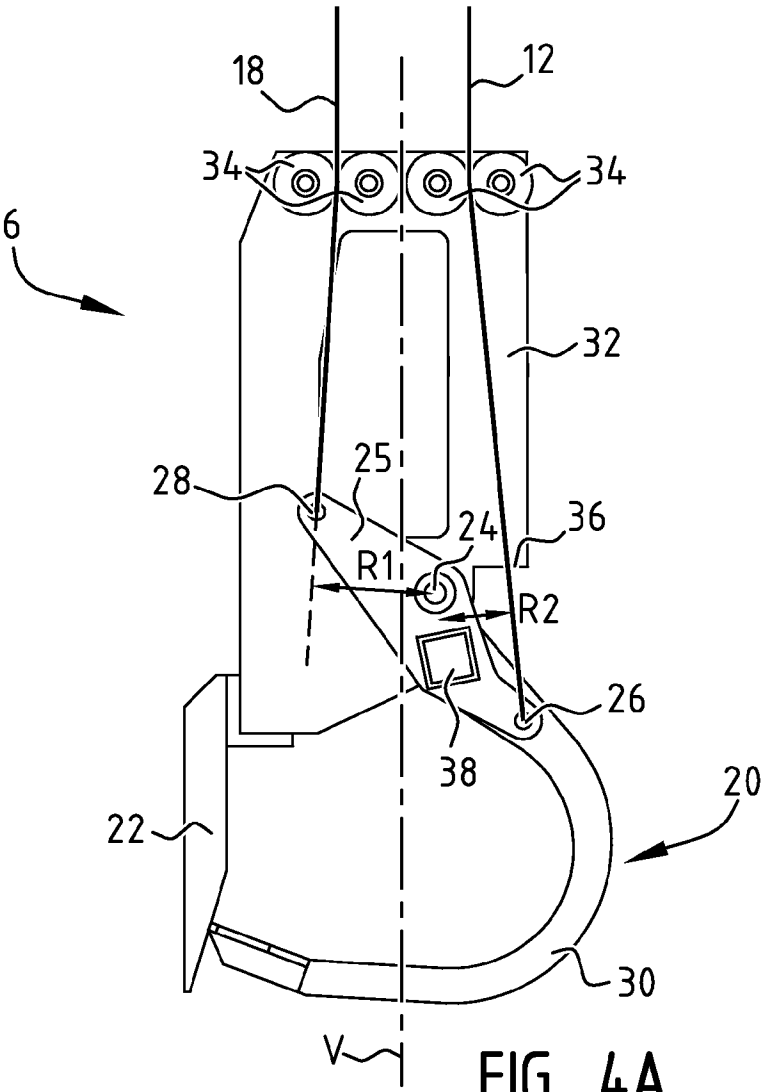
FIG. 4A is a side view of the gripper device in the closed end position.

The gripper comprises a frame 32 (FIGS. 4A, 4B) relative to which the gripper arm 20 can rotate around its rotation axis 25. Provided on the upper side of frame 32 are sheaves 34 which redirect cables 12, 18. The parts of cables 12, 18 located above frame 32 hereby extend substantially vertically in the direction of hoisting means 4, while the cable parts between sheaves 34 and points of engagement 26, 28 lie at an angle relative to the vertical direction. This angle depends only on the position of the gripper arm relative to the frame and not on the height position of the gripper arm relative to the hoisting means. In the shown embodiment gripper arm 20 is mounted on frame 32 with its rotation axis outside the centre line V running midway between cables 12 and cables 18.

As shown in the figures, the distance between the cables is smaller close to redirecting rollers 34 than the distance between points of engagement 26, 28 of the cables on tilting arm 29.

In the closed end position (FIG. 4A) the moment arm $R_1$ of the tensioning force on cables 18 is greater than the moment arm $R_2$ of the tensioning force on cables 12. In the shown embodiment the ratio $R_1$:$R_2$ is 3:2. There is hereby a net moment of force on gripper arm 20 which holds the teeth 30 against fixed gripper arm 22. Girder 38 moreover presses against stop 40 so that the force with which the gripper is pressed shut is partially absorbed by girder 38 and stop 40. If during hoisting or lowering a greater force is exerted on cable 18 than on cable 12, the moment of force which presses the gripper arm shut is then increased. If a (slightly) greater force is exerted on cable 12 than on cable 18, this difference in forces will then be compensated by the difference in length of the moment arm on either side of the rotation axis. The gripper arm therefore always remains closed. Owing to the heavier load the corresponding motor 8 will generate slippage so that it will begin to run more slowly and the equilibrium of forces will be restored.

In the opened end position (FIG. 4B) the moment arm $R_2$ on the side of cable 12 is greater than the moment arm $R_1$ on the side of cable 18. In the shown embodiment the ratio $R_1$:$R_2$ is 2:3. This results in a net moment of force which holds gripper arm 20 in the opened end position. A girder arranged on tilting arm 29 is pressed here against a stop 36 of frame 32.

When during raising or lowering of gripper arm 20 a greater force is exerted on cable 12 and on cable 18, this will then increase the moment of force so that the gripper arm is held in its open end position. If a greater force is exerted on cable 18 than on cable 12, this difference will then be compensated by the difference in the length of the corresponding moment arm. Before this difference in moment arm can be overcome, the equilibrium of forces will be restored by the slippage in electric motor 14 or a slippage coupling arranged here.

Figure 5A:
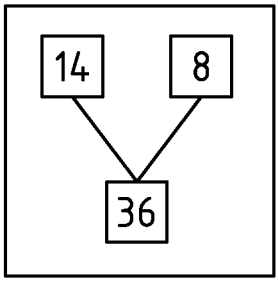
FIGS. 5A-5C show a block diagram of the control of the device according to FIGS. 1-4.
Figure 5B:
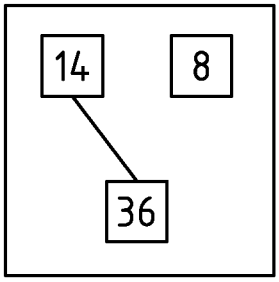
Figure 5C:
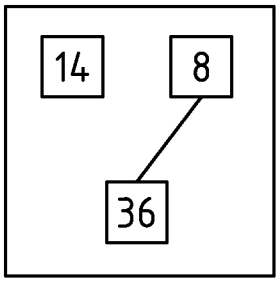

The control of gripper device 2 comprises a frequency control 36 (FIGS. 5A-5C). For raising or lowering of the gripper (FIG. 5A) the frequency control is operatively connected to motors 8 and motors 14. The motors each receive the same control signal from frequency control 36.

The controller is switchable to a mode in which only motor 14 receives the control signal (FIG. 5B). Only cable 18 is hereby hoisted or payed out, whereby the gripper respectively closes or opens. Additionally or alternatively, a switching position is provided in which a control signal is transmitted only to motor 8 (FIG. 5C). Only cable 12 is hoisted or payed out as a result, whereby the gripper respectively opens or closes.

An example of the control of device 2 for cleaning a trash rake will be described hereinbelow. Gripper 6 is initially situated a certain distance above the trash rake with the gripper arm in the opened end position. The controller is switched to the mode as according to FIG. 5A and frequency control 36 generates a control signal so that the two pairs of motors 8, 14 cause the drums to rotate so that gripper 6 is lowered. When gripper 6 has moved down to the trash rake for cleaning, teeth 30 protrude through the bars of the trash rake. Gripper 6 is then closed. For this purpose the controller is switched to the mode according to FIG. 5C in which motors 14 receive a control signal to hoist the cable 18. After closing, the controller is switched to the mode according to FIG. 5A and gripper 6 is raised. Should an unequal distribution of the load occur here, the slippage in motors 8, 14 will then prevent non-synchronous running thereof. Because the moment arm holding the gripper arm 20 pressed against stop 22 is greater than the moment arm for opening thereof, differences in forces can be compensated to a certain extent without the gripper 6 opening here.

The gripper device is preferably situated on a mobile carriage or other displaceable construction so that the whole gripper can be displaced to a waste collection location in order to there unload the scooped-up material by opening the gripper.

Figure 6:
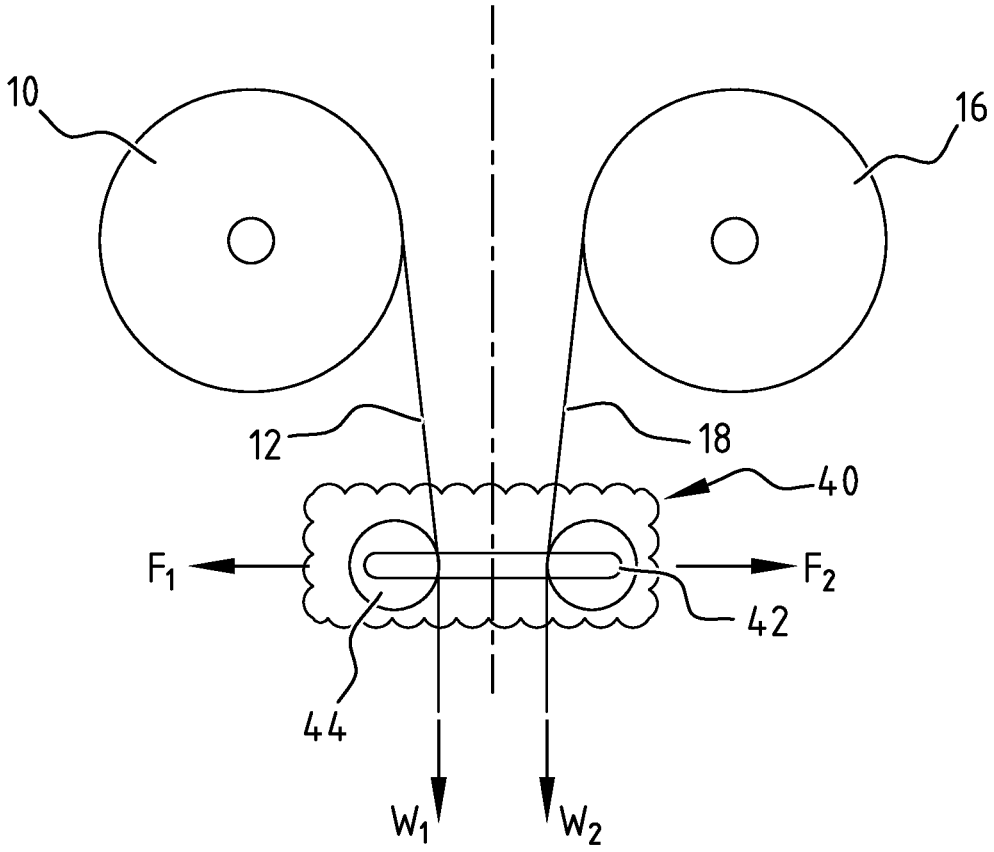
FIG. 6 shows an optional mechanism for detecting a slack cable.

Gripper device 2 optionally comprises a detection system 40 for detection of a slack cable (FIG. 6). Detection system 40 comprises two redirecting rollers 42, 44 along which cables 18 and 12 are guided. When cable 12 is tensioned by the presence of weight $W_1$, it exerts a force $F_1$ on redirecting roller 44 in horizontal direction. This force can be measured with a first sensor (not shown). Weight $W_2$ similarly provides for a tensioning force in cable 18, whereby a horizontal force $F_2$ is exerted on redirecting roller 42 by cable 18. A second sensor is provided here for measuring the force. On the basis of the forces measured by the sensors a controller of gripper device 2 can activate an alarm, switch off motors 8 or activate another safety system. The second sensor for instance measures a sudden increase in force, which means that cable 12 (or one of the group of cables 12) has snapped. In that case the first sensor will measure a decrease in force. One sensor can be provided instead of sensors on either side.

Figure 7:
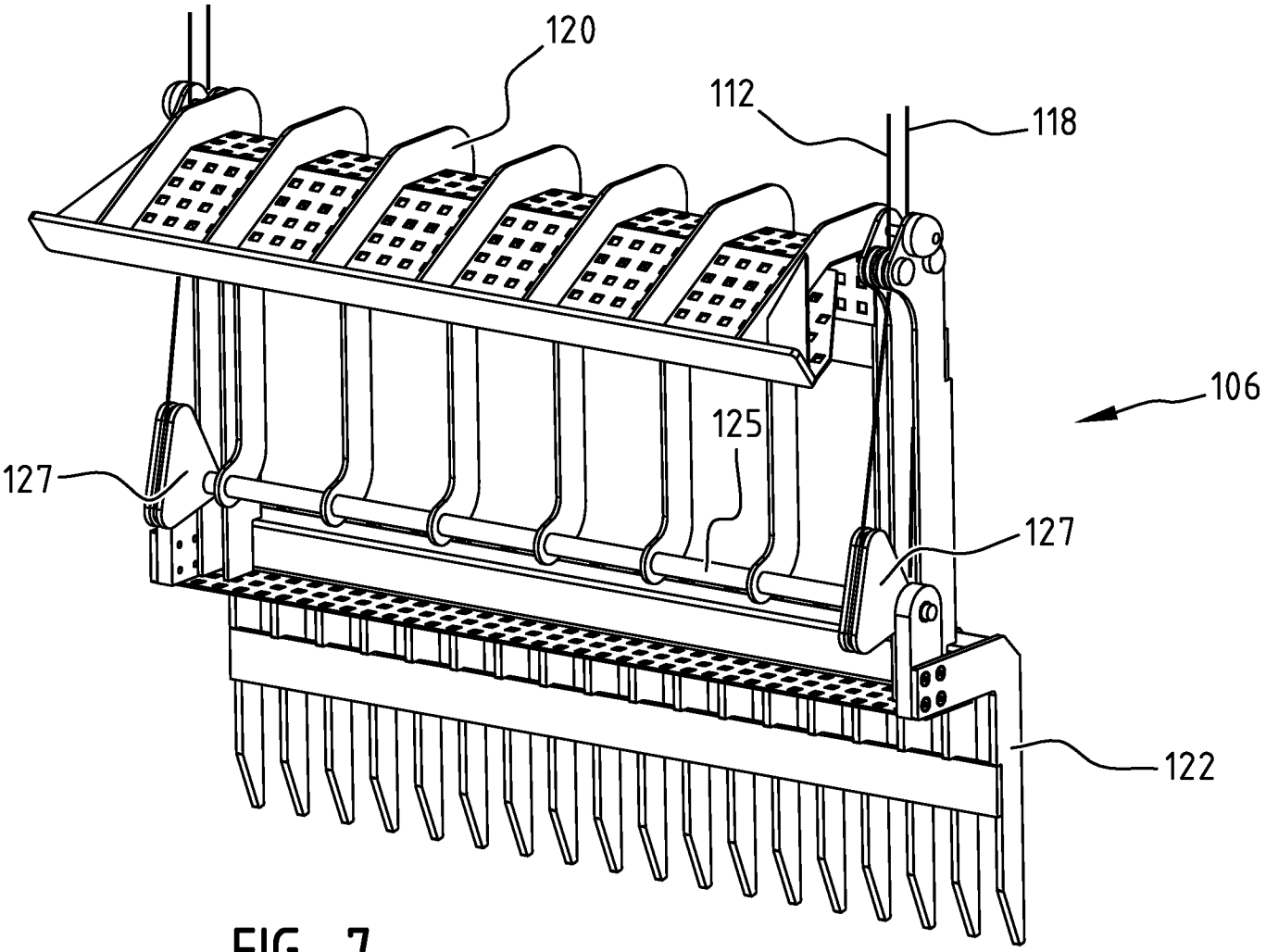
FIG. 7 is a perspective view of an alternative gripper device according to the invention.
Figure 8:
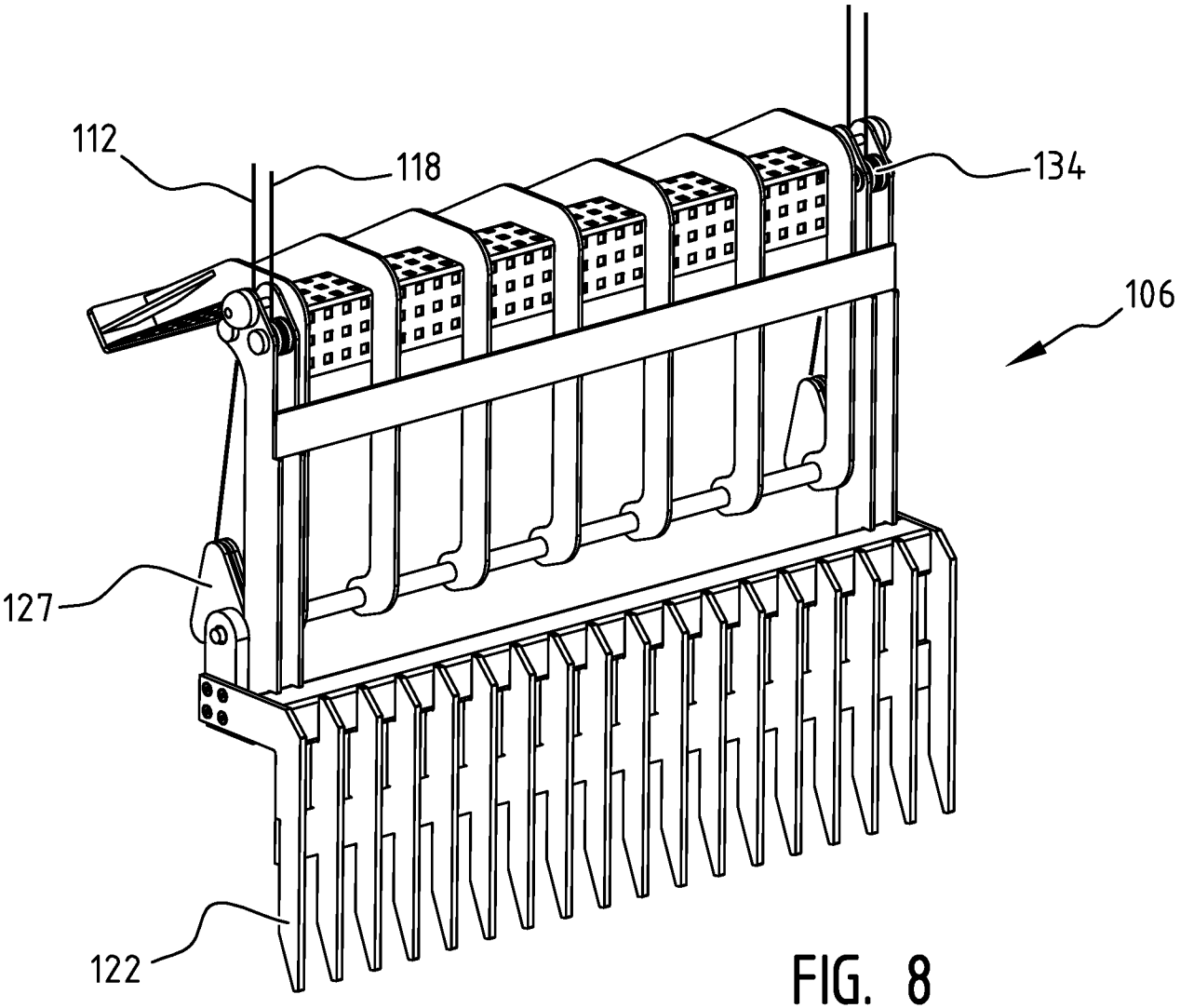
FIG. 8 is a second perspective view of the alternative gripper device.

An alternative gripper device comprises gripper 106 (FIGS. 7 and 8). Gripper 106 comprises a movable gripper arm 120 and a fixed gripper arm 122. Movable gripper arm 120 can rotate around shaft 125. Gripper 106 further comprises redirecting means 127 which are fixedly connected to shaft 125. The hoisting means of gripper 106 correspond largely to the hoisting means of gripper 6 of FIG. 1. In gripper 106 however a cable loop leading round redirecting means 127 is provided instead of engaging points on either side of rotation axis 125. A first cable parts 112, which comprises the one outer end of the cable, is attached to a first drum. A second cable part 118, which comprises the other outer end of the cable, is attached to a second run.

Figure 9:
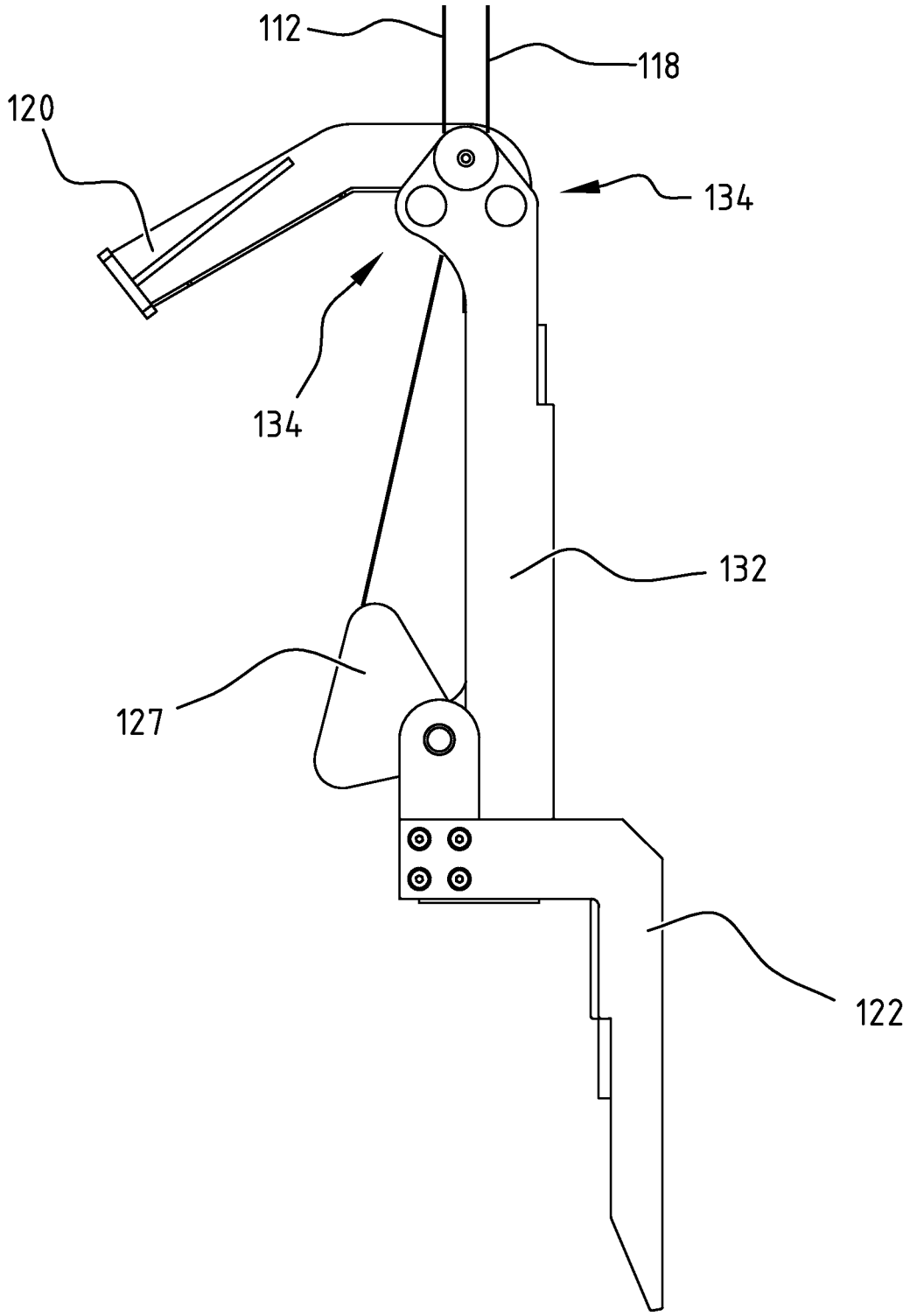
FIG. 9 is a side view of the alternative gripper device.

Gripper 106 comprises a frame 132. Redirecting rollers 134 are provided (FIGS. 8 and 9) on the upper part of frame 132 for the purpose of guiding cable parts 112, 118 in the direction of redirecting means 127.

In the shown embodiment redirecting means 127 takes the form of an isosceles triangle, the corner points which are rounded. The redirecting means is mounted on the shaft close to one of its equal angles. It is noted that other shapes and/or mounting points are also possible according to the invention. In the shown embodiment the base of the isosceles triangle is shorter than the two sides of equal length.

Figure 10:
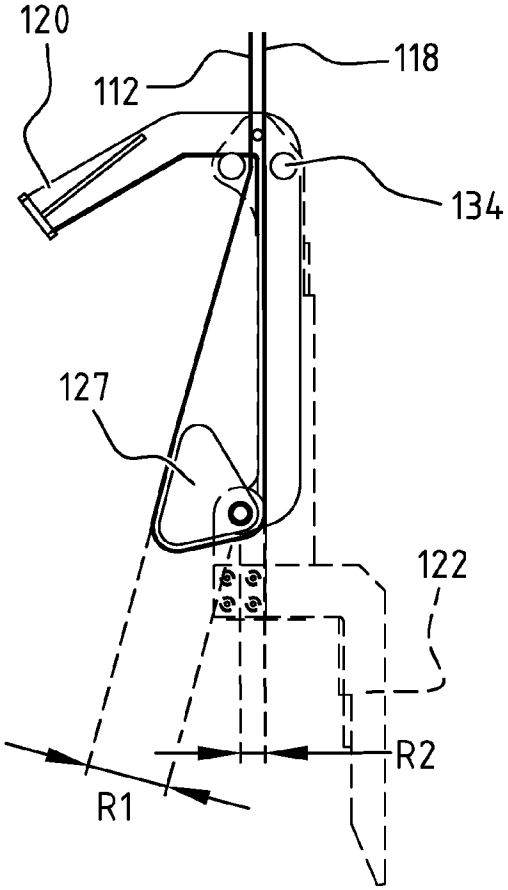

In an opened end position movable gripper arm 120 and fixed gripper arm 122 are situated at an angle of about 180 degrees relative to each other (FIG. 10). The short side of the triangular redirecting means 127 is then located on the underside so that the loop of cable 112, 118 runs over this short side. The length of moment arm R1 for opening gripper arm 120 is clearly greater here than the length of moment arm R2 for closing the gripper arm. Gripper 106 comprises a stop (not shown) for preventing the gripper arm rotating even further as a result of the force in cable 112. The position of FIG. 10 is hereby an end position of gripper 106.

Figure 11:
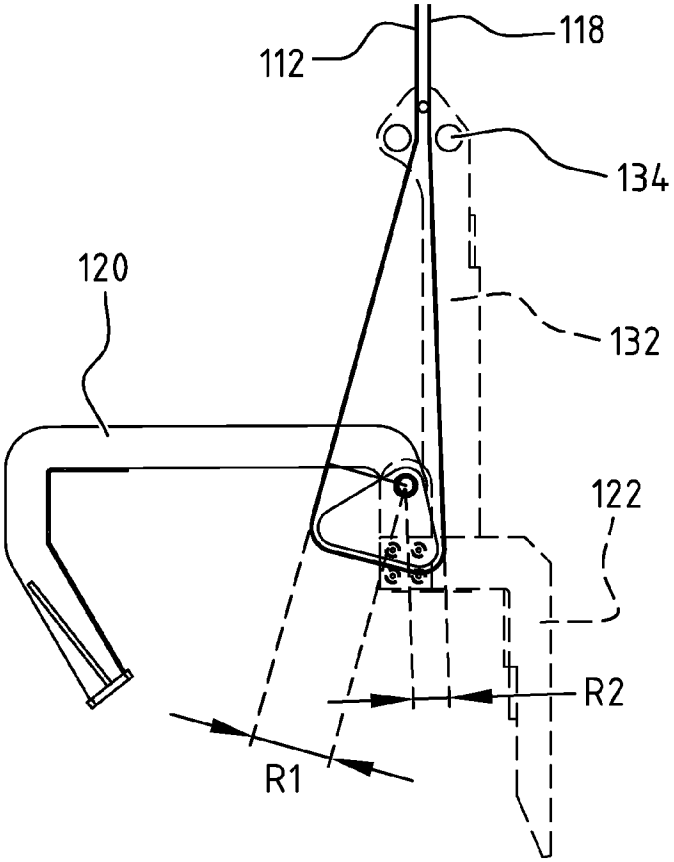

FIG. 11 shows a position of gripper arm 120 between the opened end position and the closed end position. In this position a long side of triangular redirecting means 127 is situated on the underside so that cable loop 112, 118 engages on this long side. In this situation the length of moment arm R1 for opening is also greater than the length of moment arm R2 for closing. With simultaneous operation of the hoisting means the gripper arm will thus move from the intermediate position of FIG. 11 to the end position of FIG. 10.

Figure 12:
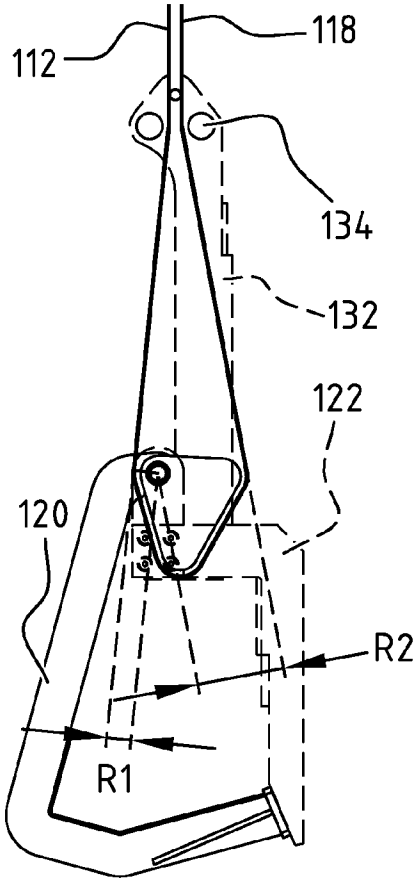
FIGS. 10-12 are side views of the alternative gripper device in an open, a semi-open and a closed state.

If however the gripper is brought into the closed end position (FIG. 12) by lowering of cable part 112 relative to cable part 118, the moment arm R1 is then smaller than the moment arm R2. This is caused by tilting of triangular redirecting means 127, the short side of which is now situated on the upper side. The cable loop therefore engages on the rounded top of triangle 127. When gripper arm 120 is thus in the closed end position, with simultaneous operation of the motors the gripper arm 120 will then tend to remain in the closed position.

The invention is by no means limited to the above described preferred embodiments thereof. The rights sought are defined by the following claims, within the scope of which many modifications can be envisaged. The invention can thus find application with gripper arms which are moved vertically, but also with gripper arms which operate to some extent at an angle.

The invention claimed is:

1. A gripper device for a trash rake cleaner, comprising:

a gripper with a gripper arm rotatable around a rotation axis such that the gripper is movable between an open end position and a closed end position; and a hoisting device connected to the gripper and comprising a first cable and a second cable which are each connected with a corresponding first outer end to the gripper and are each connected with a corresponding second outer end to respectively a first and second hoisting means for raising and lowering the gripper with the cables, wherein the first cable is attached to the gripper arm at a position of a first point of engagement and the second cable is attached to the gripper arm at a position of a second point of engagement, wherein the points of engagement are provided on either side of the rotation axis such that upward movement of the first cable relative to the second cable carries the gripper to the open end position and upward movement of the second cable relative to the first cable carries the gripper to the closed end position, wherein a first tensioning force in the first cable produces a first moment arm relative to the rotation axis, and a second tensioning force in the second cable produces a second moment arm relative to the rotation axis, the first moment arm having a greater length than the second moment arm when the gripper is in the open end position, and the first moment arm having a shorter length than the second moment arm when the gripper is in the closed end position, characterized in that the first hoisting means is driven by a first drive, and the second hoisting means is driven by a second drive that is different from the first drive, the gripper device further comprising a controller connected to the drives for controlling the drives by transmitting a control signal with the controller, wherein the controller has a hoisting mode in which the controller is configured to transmit the same hoisting control signal to both drives, and in response to receiving the hoisting control signal, both drives act at the same time to raise or lower the gripper, and wherein the controller has a gripper mode in which the controller is configured to transmit, to one of the drives and not to the other of the drives, a gripper control signal, and in response to receiving the gripper control signal, the one drive opens or closes the gripper while the other drive remains inactive, the controller comprising a switch for switching between the hoisting mode and the gripper mode, the first drive comprising a first motor, the second drive comprising a second motor that is different from the first motor, the first and second motors configured to generate slippage in response to a difference in forces between the first and second cables coupled to the first and second motors, respectively, and to restore an equilibrium of forces between the first and second cables.

2. The gripper device as claimed in claim 1, wherein the drives are suitable to each bear at least 50% of a combined load.

3. The gripper device as claimed in claim 1, wherein the hoisting device further comprises a slippage coupling.

4. The gripper device as claimed in claim 1, wherein the gripper is mounted on a frame which is also provided with one or more redirecting means for redirecting the cables, wherein each cable is guided from the respective hoisting means along the one or more redirecting means to the gripper arm.

5. The gripper device as claimed in claim 1, wherein the gripper comprises at least one stop for bounding the movement of the gripper arm.

6. The gripper device as claimed in claim 1, wherein the rotation axis is provided outside a vertical plane midway between the cables.

7. The gripper device as claimed in claim 1, wherein the distance from the rotation axis to the first point of engagement differs from the distance from the rotation axis to the second point of engagement.

8. The gripper device as claimed in claim 1, wherein the rotation axis is arranged above a line connecting the first point of engagement to the second point of engagement.

9. The gripper device as claimed in claim 1, wherein each hoisting means comprises a drum, and wherein the drums are arranged above or next to one another.

10. The gripper device as claimed in claim 1, wherein each hoisting means comprises a drum of the same diameter.

11. The gripper device as claimed in claim 1, wherein the cables have a length of at least 20 meters.

12. A gripper device for a trash rake cleaner, comprising a gripper with a gripper arm which is rotatable around a rotation axis such that the gripper is movable between an open end position and a closed end position;

a hoisting device connected to the gripper and comprising a first hoisting means, a second hoisting means and a cable, the cable comprising a first cable part which comprises a first outer end of the cable and a second cable part which comprises a second outer end of the cable, wherein the first outer end is connected to the first hoisting means and the second outer end is connected to the second hoisting means; and a redirecting means which is connected fixedly to the rotation axis and around which the cable extends for the purpose of raising and lowering the gripper arm by simultaneously respectively hoisting and lowering the first cable part and the second cable part, carrying the gripper arm to the open end position by hoisting the first cable part relative to the second cable part and carrying the gripper arm to the closed end position by hoisting the second cable part relative to the first cable part, wherein a first tensioning force in the first cable part produces a first moment arm relative to the rotation axis, and a second tensioning force in the second cable part produces a second moment arm relative to the rotation axis, the first moment arm having a greater length than the second moment arm when the gripper is in the open end position, and the first moment arm having a shorter length than the second moment arm when the gripper is in the closed end position.

13. The gripper device as claimed in claim 12, wherein the gripper arm in the open end position is rotated through more than 90 degrees relative to the closed end position.

14. The gripper device as claimed in claim 12, wherein the redirecting means has a plurality of substantially straight sides, wherein in any case two sides have an unequal length.

15. A hoisting device for a trash rake cleaner, comprising a first cable and a second cable which are each connected with a corresponding first outer end to a load carrier and which are each connected with a corresponding second outer end to respectively a first and second hoisting means for the purpose of raising and lowering the load carrier with the cables, wherein the first hoisting means is driven by a first drive, and the second hoisting means is driven by a second drive that is different from the first drive, the hoisting device further comprising one or two variable frequency drive controllers connected to the drives for controlling the drives by transmitting a control signal with the controller, wherein the controller has a hoisting mode in which the controller is configured to send the same hoisting control signal to both drives, and in response to receiving the hoisting control signal, both drives act at the same time to raise or lower the load carrier, the first drive comprising a first motor, the second drive comprising a second motor that is different from the first motor, the first and second motors configured to generate slippage in response to a difference in forces between the first and second cables coupled to the first and second motors, respectively, and to restore an equilibrium of forces between the first and second cables during the hoisting mode.

16. A trash rake cleaner comprising the gripper device as claimed in claim 1.

17. A trash rake cleaner comprising the gripper device as claimed in claim 12.

18. A trash rake cleaner comprising the hoisting device as claimed in claim 15.

19. A method for raising and lowering, and opening and closing a gripper for a trash rake cleaner as claimed in claim 1, comprising:

rotating the gripper arm around the rotation axis for the purpose of opening the gripper by moving the first cable upward relative to the second cable;

rotating the gripper arm around the rotation axis for the purpose of closing the gripper by moving the first cable downward relative to the second cable;

raising the gripper by moving both cables upward; and lowering the gripper by moving both cables downward.

* * * * *